US010729264B2

(12) United States Patent
Goldman et al.

(10) Patent No.: US 10,729,264 B2
(45) Date of Patent: Aug. 4, 2020

(54) COLLAPSIBLE HOOK HANGER

(71) Applicant: Uniplast Industries, Inc., Hasbrouck Heights, NJ (US)

(72) Inventors: Stuart Goldman, Wayne, NJ (US); King Keung Kennedy Chan, Pokfulam (HK)

(73) Assignee: UNIPLAST INDUSTRIES, INC., Hasbrouck Heights, NJ (US)

( * ) Notice: Subject to any disclaimer, the term of this patent is extended or adjusted under 35 U.S.C. 154(b) by 89 days.

(21) Appl. No.: 15/861,042

(22) Filed: Jan. 3, 2018

(65) Prior Publication Data

US 2019/0200792 A1 Jul. 4, 2019

(51) Int. Cl.
*A47G 25/32* (2006.01)
*A47G 25/38* (2006.01)
*A47G 25/14* (2006.01)

(52) U.S. Cl.
CPC ..... *A47G 25/32* (2013.01); *A47G 25/38* (2013.01); *A47G 25/1435* (2013.01); *A47G 25/1442* (2013.01)

(58) Field of Classification Search
CPC ..... A47G 25/32; A47G 25/14; A47G 25/38; A47G 25/40; A47G 25/1442; A47G 25/1435; A47G 24/1442; A41D 27/22
USPC ..... D6/328
See application file for complete search history.

(56) References Cited

U.S. PATENT DOCUMENTS 3,467,291 A 9/1969 Phillips
4,063,670 A 12/1977 Faarbech
4,168,791 A 9/1979 Clark, Jr.
5,074,445 A 12/1991 Chen
5,085,357 A 2/1992 Chen
5,456,391 A 10/1995 Chang
5,826,759 A 10/1998 Ohsugi
5,975,384 A 11/1999 Manabat
6,000,587 A 12/1999 Sackett
6,286,735 B1 9/2001 Zuckerman
7,837,074 B2 11/2010 Rude
7,905,376 B2 3/2011 Gouldson
8,113,393 B2 2/2012 Ho
8,235,261 B1 8/2012 Park
(Continued)

FOREIGN PATENT DOCUMENTS

DE 102009013081 A1 * 9/2010
WO WO 2017068344 A1 * 4/2017

*Primary Examiner* — Ismael Izaguirre
(74) *Attorney, Agent, or Firm* — Leason Ellis LLP

(57) ABSTRACT

A collapsible hook hanger includes a hook having a lower end portion that has at least one locking protrusion that extends outwardly from one face of the lower end portion. The hanger having a hanger body including a cross bar having a top wall and a hook receiving body extending from the top wall of the cross bar. The hook receiving body has a hook receiving slot and hollow interior for receiving the hook. The hook receiving body is defined by a first side wall, an opposite second side wall and a first end wall, with a floor being defined between the first side wall, the second side wall and the first end wall. Wherein at least one of the first side wall and the second side wall includes a through hole that is configured to receive the at least one locking protrusion for locking the hook in place within the hook receiving body. The hook is rotatable between a first upright position and a second folded position.

16 Claims, 5 Drawing Sheets

(56) References Cited

U.S. PATENT DOCUMENTS

| | | | | |
|---|---|---|---|---|
| 9,414,702 | B2 * | 8/2016 | Merandi | |
| 9,492,025 | B1 * | 11/2016 | Wu | A47G 25/18 |
| 9,549,630 | B2 | 1/2017 | Hansen | |
| 9,655,466 | B1 | 5/2017 | Bernstein et al. | |
| 9,820,599 | B1 | 11/2017 | Goldman et al. | |
| D826,583 | S | 8/2018 | Ho | |
| 2002/0056735 | A1 | 5/2002 | Lam | |
| 2006/0054646 | A1 | 3/2006 | Nathanmanna | |
| 2008/0283558 | A1 | 11/2008 | Rude | |
| 2009/0283556 | A1 | 11/2009 | Ho | |
| 2016/0088964 | A1 | 3/2016 | Hansen et al. | |
| 2016/0088965 | A1 | 3/2016 | Hansen et al. | |
| 2017/0325613 | A1 | 11/2017 | Goldman et al. | |
| 2018/0103785 | A1 | 4/2018 | Goldman et al. | |

* cited by examiner

COLLAPSIBLE HOOK HANGER

TECHNICAL FIELD

The present invention relates to garment hangers and more particularly, to a garment hanger having a collapsible hook.

BACKGROUND

There are a number of different types of garment hangers that are used to hold a number of different articles of clothing or other types of articles, such as linens or other household fabrics. Typically, garment hangers are either formed of a plastic material or a metal material or a combination thereof. Not only do garment hangers come in a variety of different sizes but they also come in a number of different styles that have different types of constructions to accommodate different articles that are carried by the hangers.

A traditional type of garment hanger includes a metal hook which is received in and mates to a threaded boss located on the upper frame. More specifically, one end of the metal hook is a threaded end that mates with the threaded boss. The body of the hanger is typically made of plastic.

Many times, garments that are manufactured overseas are pre-hung on a hanger and then shipped to another country as a garment/hanger combination. Upon delivery to the final retail location, the garment is simply removed from the box (packaging) and hung in the retail location. Since shipping and transportation costs are not insignificant, it is desirable to pack the garments as tight as possible in the packaging boxes/containers. However, the hooks of the garment hangers take up a significant volume of space within the packaging boxes/containers. This additional space, of course, translates into additional shipping costs.

There is therefore a need for a garment hanger that operates as a conventional hanger but is also capable of providing a reduced footprint during packaging/transportation.

SUMMARY

A collapsible hook hanger includes a hook having a lower end portion that has at least one locking protrusion that extends outwardly from one face of the lower end portion. The hanger having a hanger body including a cross bar having a top wall and a hook receiving body extending from the top wall of the cross bar. The hook receiving body has a hook receiving slot and hollow interior for receiving the hook. The hook receiving body is defined by a first side wall, an opposite second side wall and a first end wall, with a floor being defined between the first side wall, the second side wall and the first end wall. Wherein at least one of the first side wall and the second side wall includes a through hole that is configured to receive the at least one locking protrusion for locking the hook in place within the hook receiving body. The hook is rotatable between a first upright position and a second folded position.

BRIEF DESCRIPTION OF THE DRAWING FIGURES

DETAILED DESCRIPTION OF CERTAIN EMBODIMENTS

Figure 2:
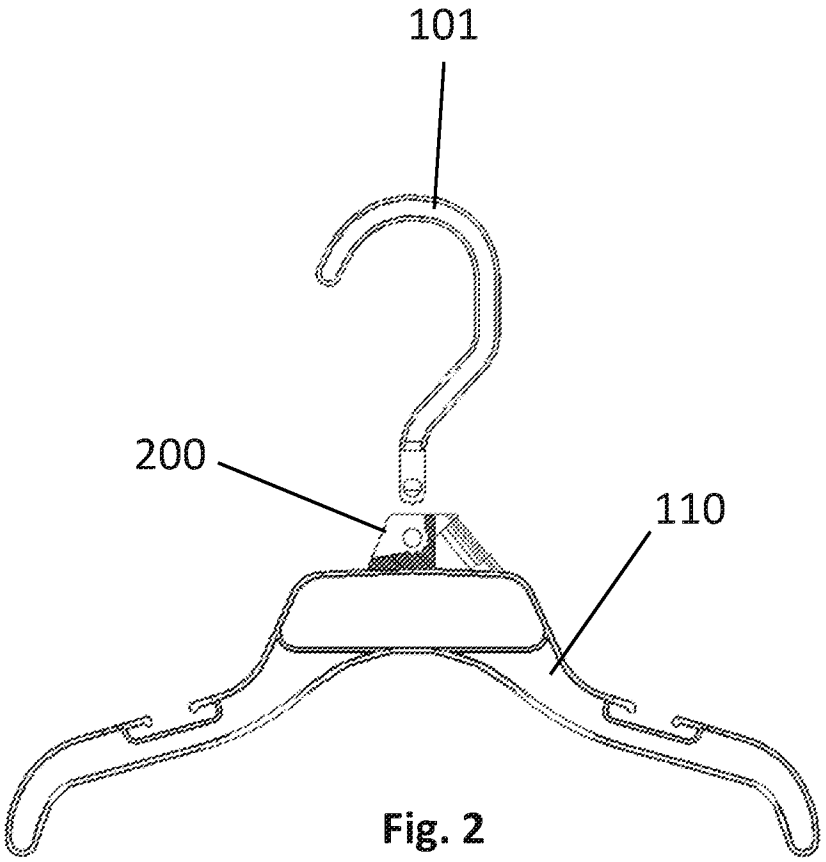
FIG. 2 is a front elevation view thereof with a front wall of the hook receiving body being removed and the hook being exploded therefrom.
Figure 1:
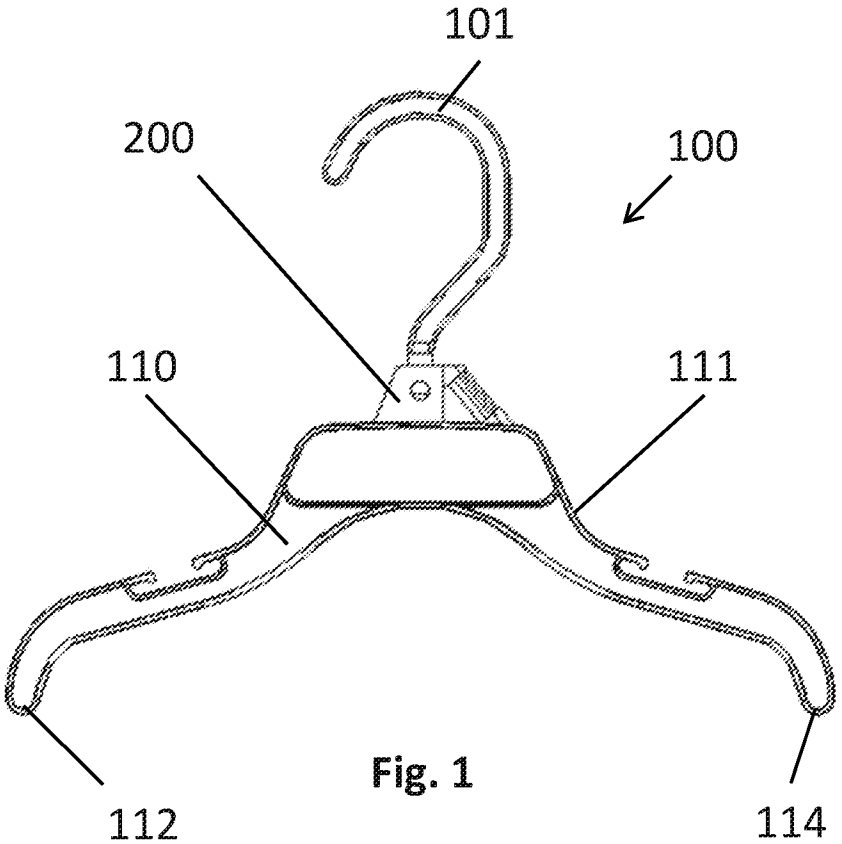
FIG. 1 is a front elevation view of a garment hanger with a collapsible hook according to one exemplary embodiment with the hook being in an upright (fully extended position)
Figure 4:
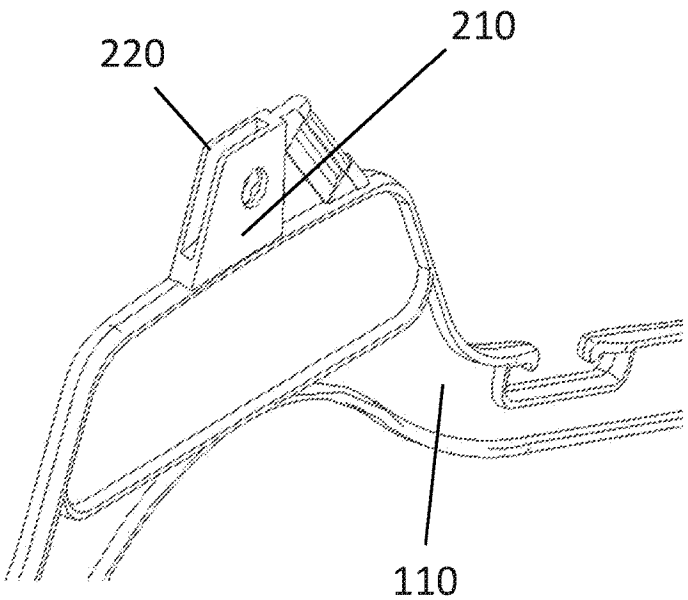
FIG. 4 is a perspective view of the center portion of the garment hanger showing the hook receiving body.
Figure 3:
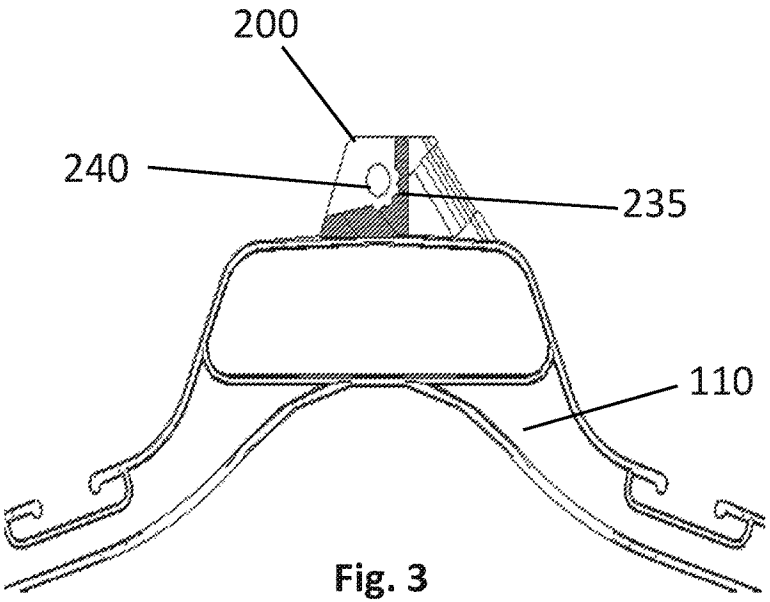
FIG. 3 is a close-up view of the center portion of the garment hanger with the front wall of the hook receiving body being removed.

FIGS. 1-9 illustrate an exemplary garment hanger 100 that includes a crossbar 110 that defines a first end 112 and an opposing second end 114. Hanger 100 also includes a central portion 120 that defines a hook receiving area. In particular, the central portion 120 includes a hook receiving body 200 that is integral to and extends outwardly from a top edge 111 of the cross bar 110.

The hook receiving body 200 is defined by a first side wall 210, an opposing second side wall 220, a first end wall 230 that connects the first side wall 210 and the second side wall 220. The hook receiving body 200 includes a floor 205 that extends between the first side wall 210, the second side wall 220 and the first end wall 230. The floor 205 has a thickness such that an exposed top surface there is elevated relative to the top edge 111. The first and second side walls 210, 220 are parallel to one another and the first side wall 210 can be thought of as being a rear wall. The first and second side walls 210, 220 can be angled (other than 90 degrees) relative to the top edge of the cross bar 110 or can be formed at 90 degrees as shown.

The three walls 210, 220, 230 define a hollow interior space 245 that is open along its top since there is no wall structure that extends across the top edges of the three walls 210, 220, 230. Thus, the hook receiving body 200 includes a top opening which, as described below, is configured to receive a hook 101, and forms an entrance into the hollow interior space 245.

The first end wall 230 can be a completely solid wall that extends between the first and second side walls 210, 220.

The first side wall 210 has an opening 240 formed therein. More specifically, the opening 240 defines an entrance into the hollow interior space 245 defined within the hook receiving body 210. The opening 240 is a through hole that can have any number of different shapes and in the illustrated embodiment, the opening 240 has a generally circular shape. The opening 240 can be centrally formed in the first side wall 210.

Similarly, the second side wall 220 has an opening 240 formed therein. More specifically, the opening 240 defines an entrance into the hollow interior space 245 defined within the hook receiving body 210. The opening 240 is a through hole that can have any number of different shapes and in the illustrated embodiment, the opening 240 has a generally circular shape. The opening 240 can be centrally formed in the second side wall 220. It will be appreciated that the shapes and sizes of the openings 240 can be the same and are axially aligned with one another.

The floor 205 can be at angle in that it can be at an incline relative to the top edge 111 and relative to the first end wall 210.

As shown in the figures, an inner surface of the first end wall 230 has a recessed profile 235 and more particularly, the recessed profile 235 is in the form of one or more scalloped shaped recesses formed along a bottom portion of the first end wall 230. Moreover, a portion of the floor 205 also has a recessed profile and in particular, an inner portion of the floor 205 that is adjacent the bottom portion of the first end wall 230 includes the recessed profile 235 in the form of one or more recesses. In other words, the recesses formed in the floor 205 and the lower portion of the first end wall 230 defines a continuous recessed profile 235 that extends from the floor 205 to the first end wall 230. In the illustrated embodiment, the recessed profile 235 comprises a plurality of scalloped shaped recesses that are formed in the corner of the hollow interior of the hook receiving body (e.g., at the interface between the first end wall 230 and the floor 205). The openings 240 are located proximate the scalloped shaped recesses 235.

Figure 6:
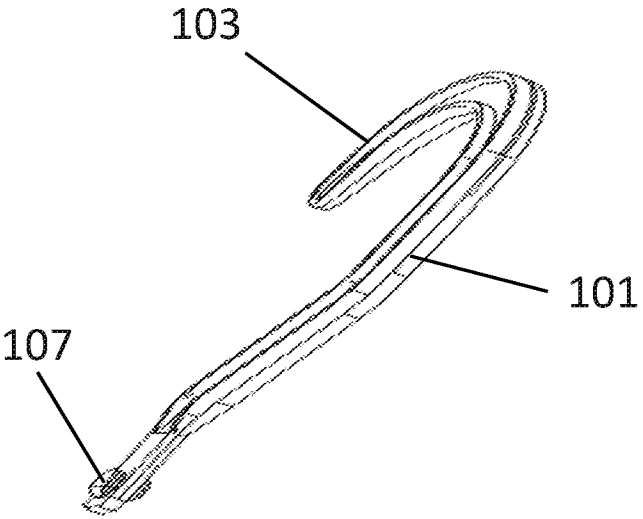
FIG. 6 is a side perspective view of the hook.
Figure 5:
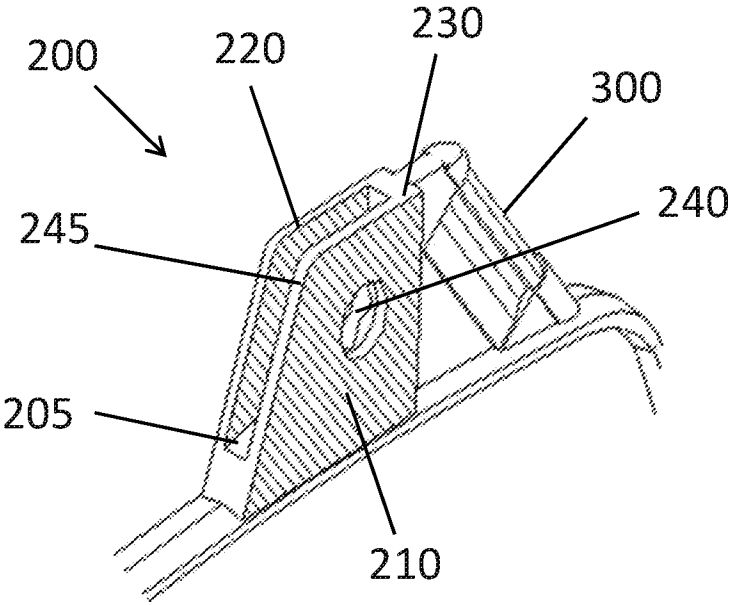
FIG. 5 is a close-up of the hook receiving body.
Figure 8:
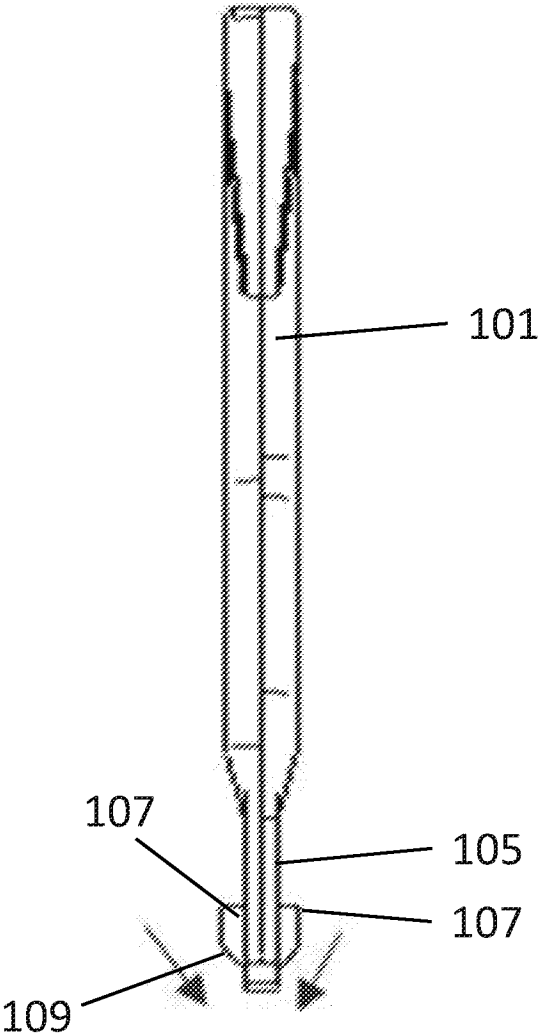
FIG. 8 is a side elevation view thereof.
Figure 7:
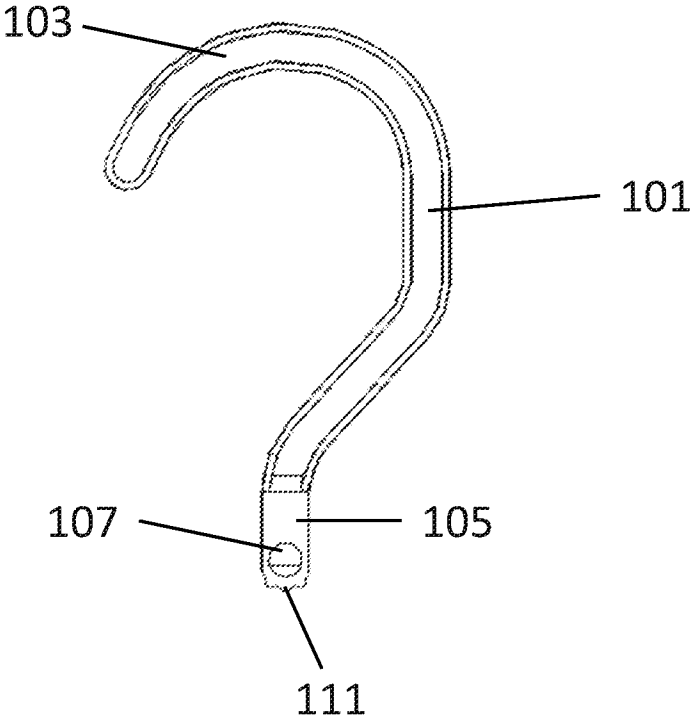
FIG. 7 is a front elevation view of the hook.
Figure 9:
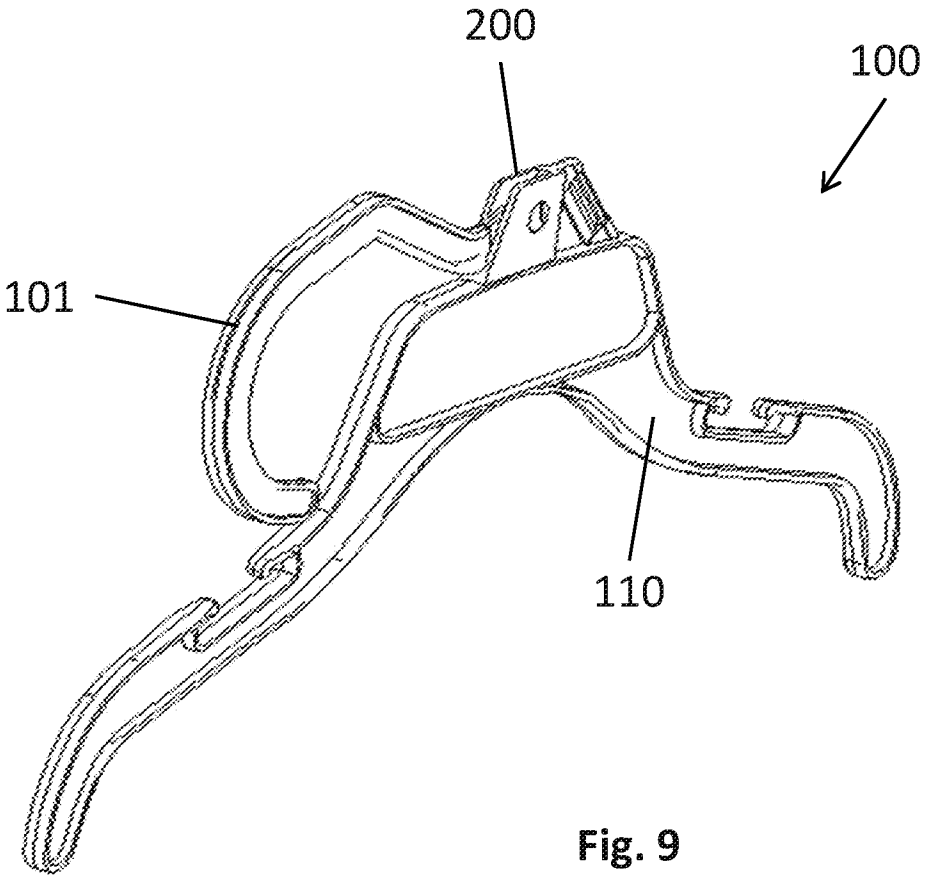
FIG. 9 is a perspective view of the garment hanger with the hook being in a lowered (collapsed) position.

FIGS. 6-8 illustrate the hook 101 that is configured for use with the hook receiving body 200 and more particularly, the hook 101 is configured to move between a first upright position (FIG. 1) and a second collapsed position (FIG. 9). The hook 101 has a hook portion 103 at an upper end and a lower portion 105 that can be a linear portion. The lower portion 105 is configured to have two opposing protrusions 107 that protrude outwardly from two opposing faces of the lower portion 105. More particularly, one protrusion 107 extends outwardly from one face of the lower portion 105 and a second protrusion 107 extends outwardly from an opposing face of the lower portion 105.

The two protrusions 107 are thus axially aligned with one another. In addition, the two opposing faces of the lower portion 105 can be in planar in shape (i.e., flat faces) and thus, the protrusion 107 can be formed normal (perpendicular) to the planar face. As shown in FIG. 8, the two opposing faces taper inwardly to the flat portions.

The shape and size of the protrusion 107 are selected in view of size and shape of the opening 240 and in particular, each protrusion 107 is configured to be received within the opening 240 as a means for securely and pivotally coupling the hook 101 to the hook receiving body 200.

As mentioned previously, when the openings 240 have a circular shape, the protrusions 107 likewise have a circular shape to allow the mating between the protrusions 107 and the complementary openings 240. A friction fit or the like can be established between the protrusions 107 and the side walls of the hook receiving body as a means for securely attaching the hook 101 to the hook receiving body 200 while permitting rotation (pivoting) of the hook 101 relative to the hook receiving body 200.

As shown in FIG. 8, the protrusion 107 can have a non-uniform thickness in that a lower section 109 of the protrusion 107 has a reduced thickness relative to the other section of the protrusion 107. As shown, the lower section 109 can be beveled section that progressively gets thinner in a direction toward to the bottom of the protrusion 107. In the figures, a line extending across a width of the protrusion 107 demarcates where the lower section 109 is formed. The lower section 109 acts as a cam surface to permit reception within the hollow interior space of the hook receiving body 200. In particular, when the hook 101 is inserted into the hollow interior, the lower beveled section 109 of the protrusion 107 contacts the top edges of the first side wall 210 and the second side wall 220 and the beveled nature of the lower section 109 causes the outward flexing of the first side wall 210 and the second side wall 220 to accommodate reception of the protrusions 107 within the hollow interior of the hook receiving body 200. The protrusions 107, and in particular, the lower sections 109, ride along the inner surfaces of the first side wall 210 and the second side wall 220 until the protrusions 107 are in registration with the openings 240 resulting in the protrusions 107 being fully received and locked in place within the openings 240.

The lower portion 105 of the hook 101 includes a locking feature that mates with the recessed profile formed in the hook receiving body 200 to allow the hook 101 to be held in a selected position. More specifically, the locking feature can be in the form of one or more locking protrusions 111 that protrude outwardly from a bottom edge of the lower portion 105. As shown, the bottom edge of the lower portion 105 that defines one end of the hook 101 can have an arcuate shape (curved edge) and the locking protrusions 111 can be in the form of a plurality of scalloped shaped protrusions 111. It will be appreciated that the size and shape of the locking protrusions 111 is selected in view of the recessed profile 235 in that the locking protrusions are received within the recessed profile 235 for holding the hook 101 in a desired position. However, when the hook 101 is caused to rotate (pivot) within the openings 240, the locking protrusions 111 disengage from the recessed profile 235 and then the locking protrusions 111 reengage the recessed profile 235 in a different position. In particular, when the hook 101 is in the upright position, the locking protrusions 111 engage the recesses formed along the floor 205 and when the hook 101 rotates, the locking protrusions 111 pivot and move into engagement with the recesses formed along the first end wall 230. Thus, when the hook 101 is in the collapsed position of FIG. 9, the locking protrusions 111 are received within the recesses (of recessed profile 235) formed along the first end wall 230.

The construction of the hook 101 and the hook receiving body 200 are intended to provide a permanent connection.

It will be appreciated that the garment hanger 100 described herein can be formed of a number of different materials, including but not limited to different plastics and thus, they can be formed by a molding process, such as injection molding.

As shown in the figures, a top sizer section 300 can be provided at a location adjacent the hook receiving body 200 for receiving a top sizer.

While the use of two protrusions 107 is preferred since it effectively locks the hook 101 into both the first side wall 210 and the second side wall 220, it will be understood that only one protrusion 107 can be used to attach the hook 101 to the hook receiving body 200 (i.e., the opening 240 is formed in either the first side wall 210 or the second side wall 220).

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. A collapsible hook hanger comprising:

a hook having a lower end portion that has at least one locking protrusion that extends outwardly from one face of the lower end;

a hanger body including a cross bar having a top wall;

a hook receiving body extending from the top wall of the cross bar, the hook receiving body having a hook receiving slot and hollow interior for receiving the hook, the hook receiving body being defined by a first side wall, an opposite second side wall and a first end wall, with a floor being defined between the first side wall, the second side wall and the first end wall, wherein at least one of the first side wall and the second side wall includes a through hole that is configured to receive the at least one locking protrusion for locking the hook in place within the hook receiving body; and wherein the hook is rotatable between a first upright position and a second folded position;

wherein a bottom edge of the lower end portion includes a second locking protrusion that is detachably received within a complementary recessed profile formed within the hollow interior of the hook receiving body;

wherein the bottom edge has an arcuate shape and the second locking protrusion comprises a plurality of scalloped shaped protrusions and the recessed profile comprises a plurality of scalloped shaped recesses;

wherein the at least one locking protrusion comprises a pair of locking protrusions extending outwardly from opposite faces of the lower end portion of the hook, and wherein each of the first side wall and the second side wall includes one through hole for receiving the pair of locking protrusions.

2. The collapsible hook hanger of claim 1, wherein the hook has a curved upper end and the lower end portion has a first planar face and an opposite second planar face, the at least one locking protrusion protruding outwardly from one of the first planar face and the second planar face.

3. The collapsible hook hanger of claim 1, wherein the plurality of scalloped shaped recesses is formed along the floor and the first end wall.

4. The collapsible hook hanger of claim 3, wherein in the first upright position, at least one of the plurality of the scalloped shaped protrusions is received within at least one of the plurality of scalloped shaped recessed formed along the floor.

5. The collapsible hook hanger of claim 4, wherein in the second folded position, at least one of the plurality of the scalloped shaped protrusions is received within at least one of the plurality of scalloped shaped recessed formed along the first end wall.

6. The collapsible hook hanger of claim 1, wherein there are three scalloped shaped protrusions and there are four scalloped shaped recesses.

7. The collapsible hook hanger of claim 1, wherein the pair of locking protrusions are axially aligned and the through holes are axially aligned.

8. The collapsible hook hanger of claim 1, wherein each of the pair of locking protrusion is generally circular shaped and each of the through holes is generally circular shaped.

9. The collapsible hook hanger of claim 1, wherein the through hole is circular shaped and the at least one locking protrusion is generally circular shaped and the at least one locking protrusion has a lower beveled section.

10. The collapsible hook hanger of claim 9, wherein the lower beveled section has an arcuate shaped outer edge and has a thickness less than a thickness of an upper section of the at least one locking protrusion.

11. The collapsible hook hanger of claim 10, wherein the first side wall and the second side wall are flexible and the lower beveled section comprises a cam surface that serves to separate and flex the first side wall and the second side wall in directions away from one another to allow for reception of the upper section and whereupon reception of the at least one locking protrusion within the through hole, the first side wall and the second side wall flex back to initial unflexed positions.

12. The collapsible hook hanger of claim 1, wherein the opposite faces are parallel to one another.

13. A collapsible hook hanger comprising:

a hook having a lower end portion that has at least one first locking protrusion that extends laterally outwardly from one face of the lower end, the at least one first locking protrusion being spaced upwardly from a bottom edge of the lower end portion, wherein the bottom edge includes a plurality of second locking protrusions that extend downwardly and define a bottom end of the hook, the at least one first locking protrusion having an angled bottom edge;

a hanger body including a cross bar having a top wall;

a hook receiving body extending from the top wall of the cross bar, the hook receiving body having a hook receiving slot and hollow interior for receiving the hook, the hook receiving body being defined by a first side wall, an opposite second side wall and a first end wall, with a floor being defined between the first side wall, the second side wall and the first end wall, wherein at least one of the first side wall and the second side wall includes a through hole that is configured to receive the at least one first locking protrusion for locking the hook in place within the hook receiving body; and wherein the hook is rotatable between a first upright position and a second folded position;

wherein the plurality of second locking protrusions are received within a complementary recessed profile formed within the hollow interior of the hook receiving body and permit rotation between the first upright position and the second folded position.

14. The collapsible hook hanger of claim 13, wherein the plurality of second locking protrusions comprise a plurality of scalloped shaped protrusions and the recessed profile comprises a plurality of scalloped shaped recesses.

15. The collapsible hook hanger of claim 13, wherein the at least one first locking protrusion is formed at a right angle relative to the plurality of second locking protrusions.

16. A collapsible hook hanger comprising:

a hook having a lower end portion that has a pair of coaxial locking protrusions extending laterally outwardly from opposite faces of the lower end portion of the hook, wherein a bottom edge of the lower end portion includes a plurality of second locking protrusions that extend downwardly and define a bottom end of the hook;

a hanger body including a cross bar having a top wall;

a hook receiving body extending from the top wall of the cross bar, the hook receiving body having a hook receiving slot and hollow interior for receiving the hook, the hook receiving body being defined by a first side wall, an opposite second side wall and a first end wall, with a floor being defined between the first side wall, the second side wall and the first end wall, wherein each of the first side wall and the second side wall includes a through hole that is configured to receive the pair of locking protrusions for locking the hook in place within the hook receiving body; and wherein the hook is rotatable between a first upright position and a second folded position;

wherein each of the pair of locking protrusions has an angled bottom edge to permit the pair of locking protrusions to slide into the respective through holes;

wherein the plurality of second locking protrusions are received within a complementary recessed profile formed partially along the floor and a majority of the recessed profile is formed along an inner surface of the first end wall that extends upwardly from the floor and is located along one side of the through holes.

* * * * *